US005920926A

United States Patent [19]

Torres

[11] Patent Number: 5,920,926

[45] Date of Patent: Jul. 13, 1999

[54] EASY SHAVE FOOT SUPPORT

[76] Inventor: Colleen Petruzz Torres, 63-21 Boelsen Crescent, Rego Park, N.Y. 11374

[21] Appl. No.: 08/940,774

[22] Filed: Sep. 30, 1997

[51] Int. Cl.[6] ..... A47K 3/12

[52] U.S. Cl. ..... 4/574.1; 4/611

[58] Field of Search ..... 4/254, 571.1, 574.1, 4/611

[56] References Cited

U.S. PATENT DOCUMENTS

D. 170,853 11/1953 Dunham ..... 4/574.1 X
1,265,609 5/1918 Carry ..... 15/265
3,275,283 9/1966 Rauch ..... 4/574.1 X
4,489,448 12/1984 Cairo ..... 4/574.1
5,341,528 8/1994 Sultzbaugh ..... 4/611
5,579,545 12/1996 Beard ..... 4/574.1

*Primary Examiner*—Robert M. Fetsuga
*Attorney, Agent, or Firm*—Michael I. Knoll

[57] ABSTRACT

An easy shave foot support (10) comprising a component (12) for supporting a foot (14) of a person (16). A structure (18) is for elevating the foot supporting component (12) within a bathtub or shower stall (20), at a height convenient for the person (16) to safely shave their legs (22) with a razor (24) while taking a shower.

17 Claims, 5 Drawing Sheets

EASY SHAVE FOOT SUPPORT

BACKGROUND OF THE INVENTION

1. Field of the Invention

The instant invention relates generally to footrest devices and more specifically it relates to an easy shave foot support. The easy shave foot support will elevate a human foot, so that a person can shave their legs in safety within a bathtub or shower stall.

2. Description of the Prior Art

Numerous footrest devices have been provided in prior art. For example, U.S. Pat. Nos. 1,265,609 to Carry; 3,275,283 to Rauch; 4,489,448 to Cairo; 5,341,528 to Sultzbaugh; 5,579,545 to Beard and Des. 170,853 to Dunham all are illustrative of such prior art. While these units may be suitable for the particular purpose to which they address, they would not be as suitable for the purposes of the present invention as heretofore described.

CARRY, CHARLES A.

FOOT REST

U.S. Pat. No. 1,265,609

A foot rest of the character described comprising a foot-supporting plate provided at its ends with depending flanged portions. Curved leg-attaching plates are secured to the foot-supporting plate and abut the flanged portions. Wire legs are connected with the leg-attaching plates. Each leg comprising a wire bent into a loop form to provide a foot. A brace member is provided with means for closely engaging all of the strands of the wires forming the respective legs.

RAUCH, LAUREN F.

FOLDING FOOT REST

U.S. Pat. No. 3,275,283

In a folding foot rest and seat the combination of a housing unit, a foot rest unit and a seat unit supported on the housing unit. The seat unit being removable from the housing unit. The foot rest unit being pivotable between a storage position within the housing and a utility position outside of the housing.

CAIRO, JOHN B.

FOOT SUPPORT FOR SHOWERS

U.S. Pat. No. 4,489,448

A foot support for use in a shower stall or bathtub enclosure during showering, whereon a person can rest or support his foot while applying soap thereto. The support includes a series of indentations therein that confirm to a bather's foot, either left or right. The foot is rested and supported as it is soaped, eliminating slippage thereof as it is pivoted and canted as it is washed.

SULTZBAUGH, CAROLINE

FOOT REST FOR USE IN A SHOWER

U.S. Pat. No. 5,341,528

A foot rest comprising an elongated body portion presenting opposed ends having a general cross-sectional shape of a right-angle triangle for placement in a corner of a shower stall such that the hypotenuse of the triangular cross section forms a front wall of the body portion is disclosed. One of the opposed ends forms an endmost bottom section for resting on a floor of a shower stall. The bottom section generally conforming to the slope of the shower stall floor such that the body portion generally stands perpendicular to the horizontal when placed in the stall. The other opposed end forms a generally planar top section for allowing a user to rest a foot thereon.

BEARD, JANEEN E.

COMBINED FOOT SUPPORT AND GROOMING NEEDS HOLDER

U.S. Pat. No. 5,579,545

A combined foot support and grooming needs holder device, designed to securely provide elevation and support for a human foot and grooming needs, while washing, drying, pedicuring the foot or shaving the leg, for use inside or outside of the shower or bathtub. The present invention consists of a two-part single legged elongate support member and a two-part platform, so that the human foot and grooming needs may be located near each other while in use.

DUNHAM, SIDNEY R.

SHOWER FOOTREST

U.S. Pat. No. Des. 170,853

A new original and ornamental design for a shower footrest, of which the following is a specification.

SUMMARY OF THE INVENTION

Figure 1:
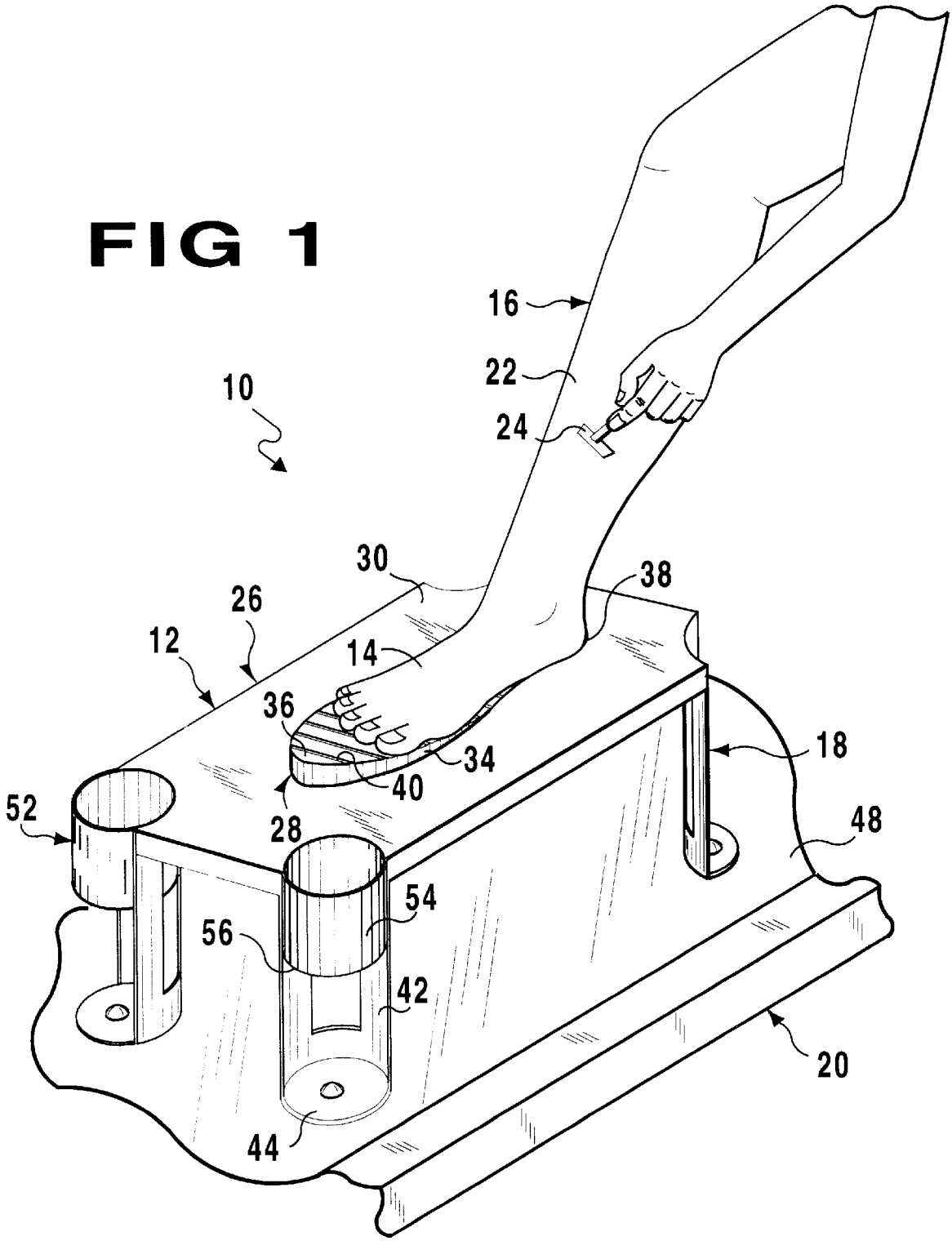
FIG. 1 is a top perspective view of the shower footrest showing the new design.

A primary object of the present invention is to provide an easy shave foot support that will overcome the shortcomings of the prior art devices.

Another object is to provide an easy shave foot support that will elevate a human foot within a bathtub or shower stall in a comfortable position, so that a person can conveniently shave their legs in safety.

An additional object is to provide an easy shave foot support in which suction cups or small round rubber plugs on the bottom of its legs will hold it in place within the bathtub or shower stall, so that it will not slide.

A further object is to provide an easy shave foot support that is simple and easy to use.

A still further object is to provide an easy shave foot support that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a top perspective view of the instant invention in use.

Figure 2:
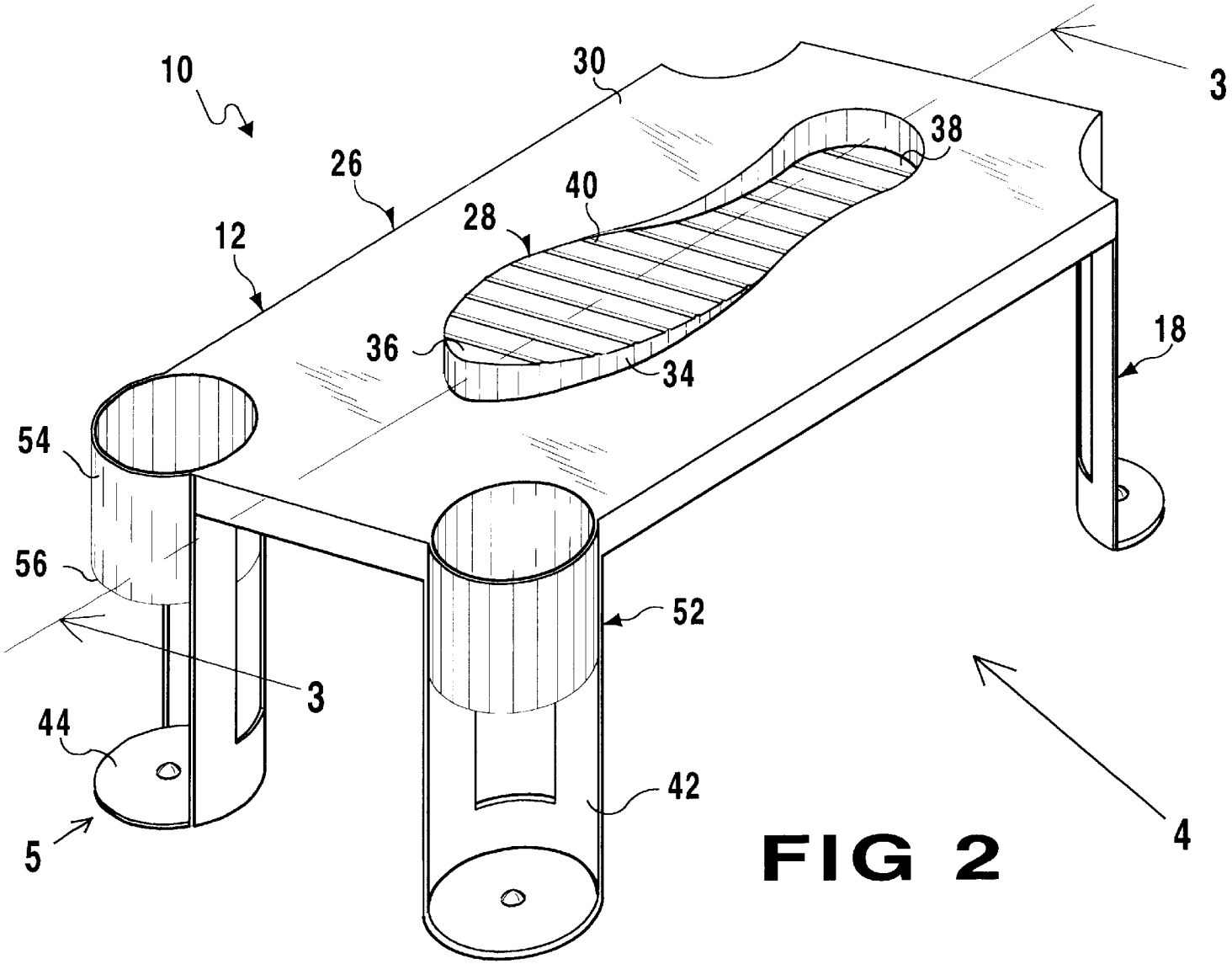
FIG. 2 is a side view thereof.

FIG. 2 is an enlarged top perspective view of the instant invention per se.

Figure 3:
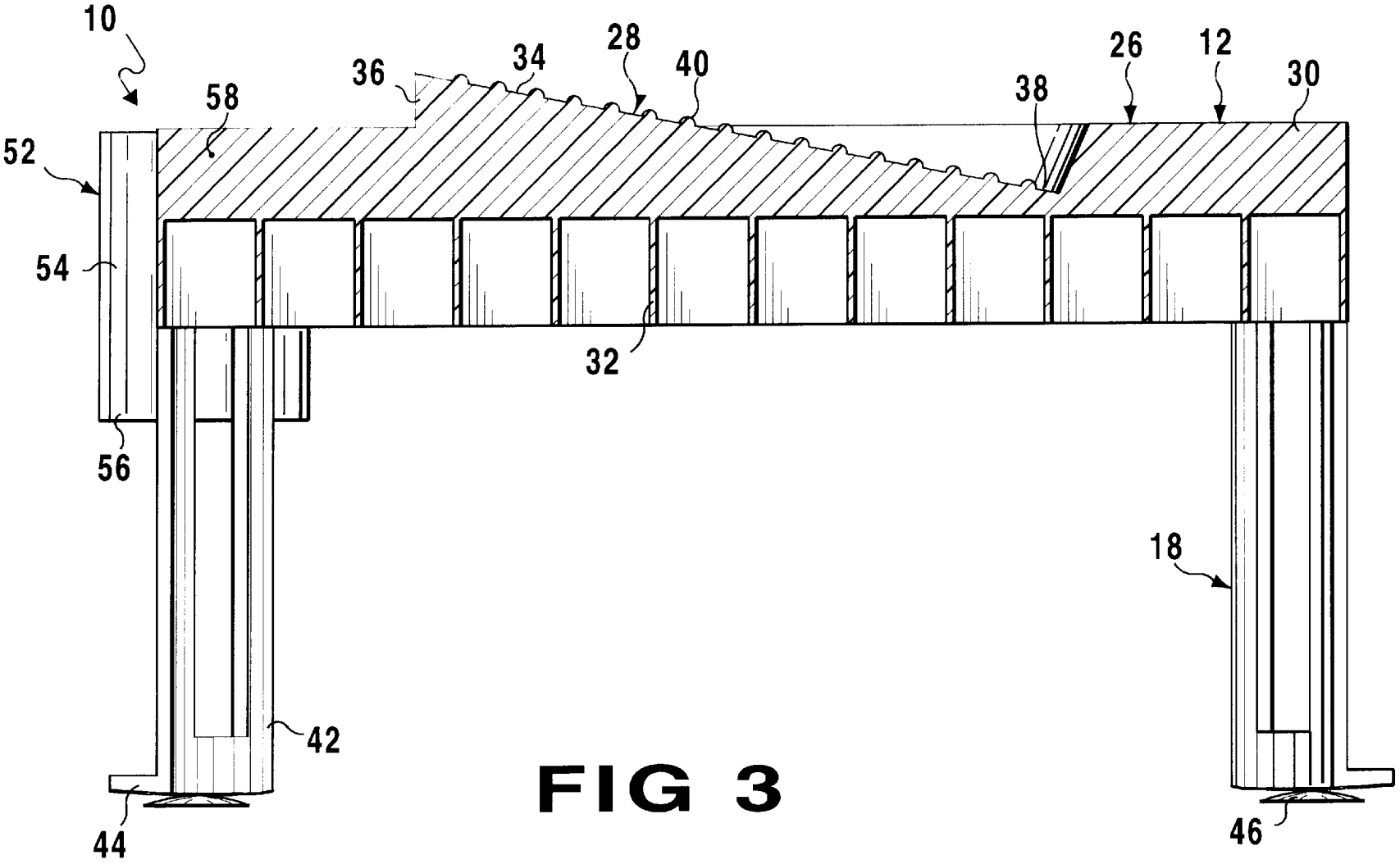
FIG. 3 is a bottom plan view thereof.

FIG. 3 is a cross sectional view taken along line 3—3 in FIG. 2.

Figure 4:
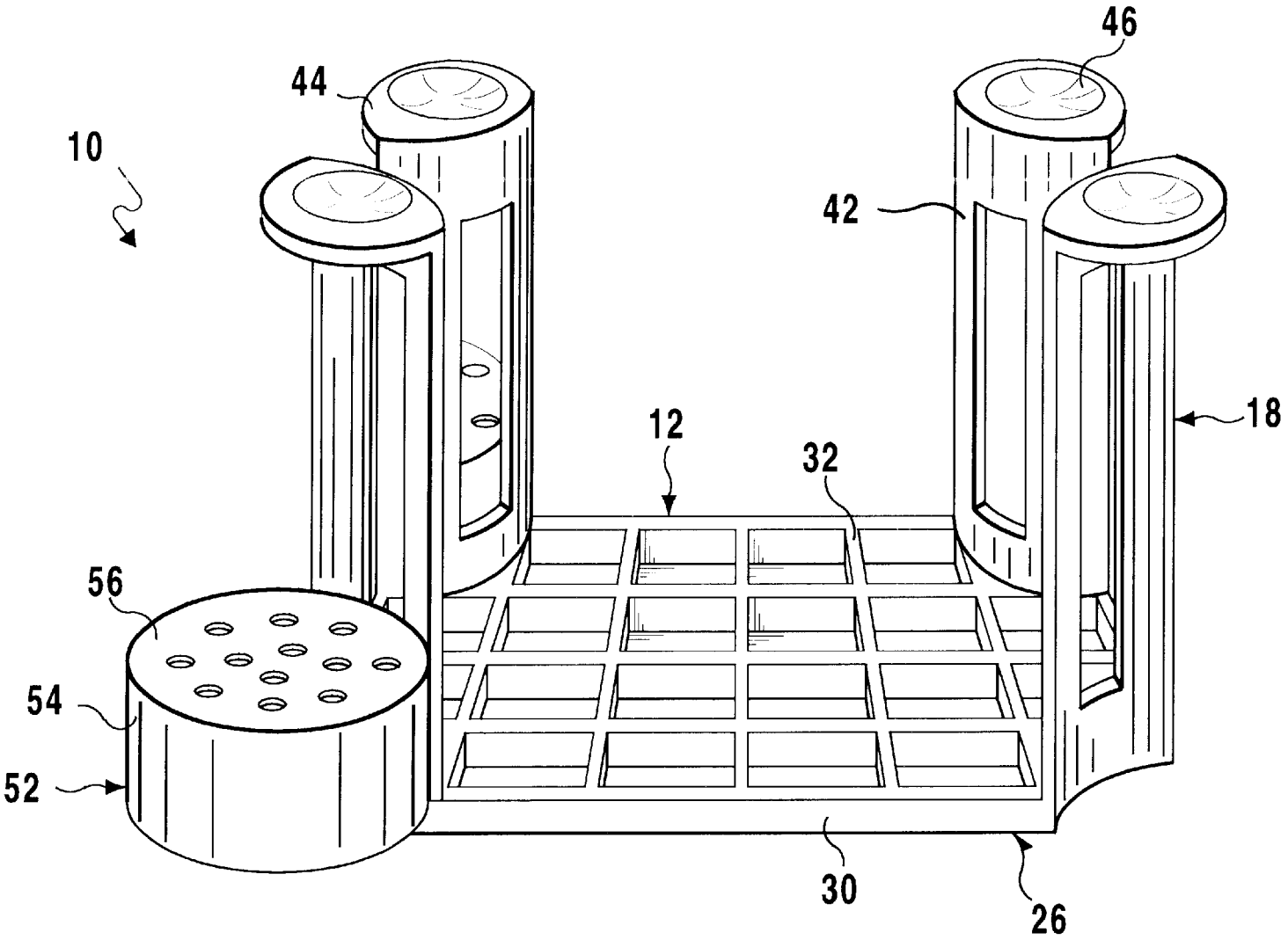
FIG. 4 is an end elevational view thereof in one upset position with parts broken away.

FIG. 4 is a bottom perspective view taken in the direction of arrow 4 in FIG. 2.

Figure 5:
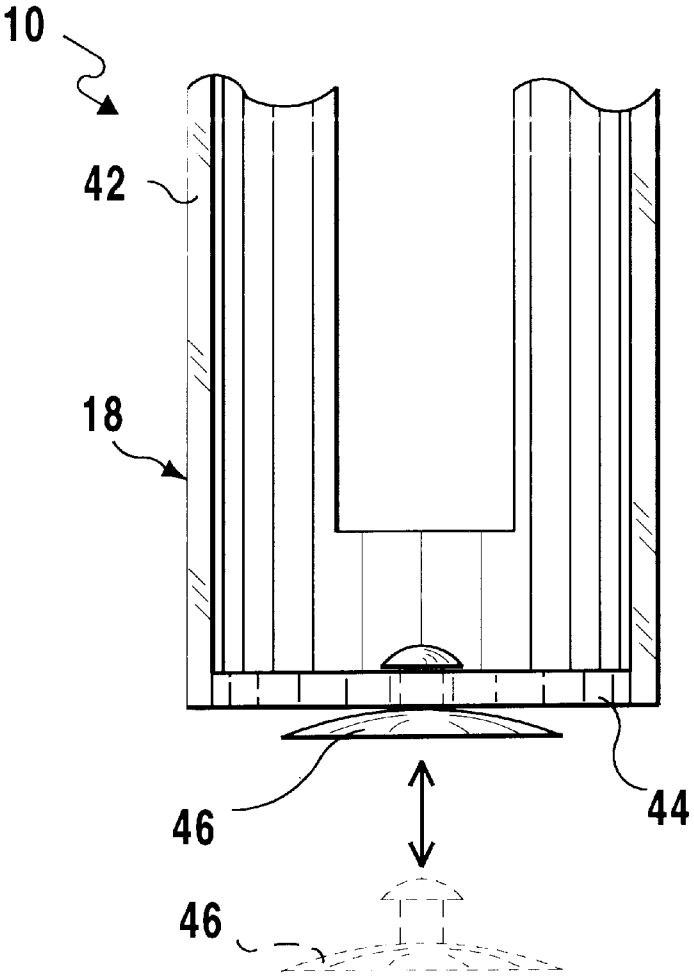
FIG. 5 is a side view thereof in a different upset position.

FIG. 5 is an enlarged front elevational view of a lower portion of one leg taken in the direction of arrow 5 in FIG. 2, showing the suction cup connected to the foot of the leg in greater detail for use in a bathtub.

Figure 6:
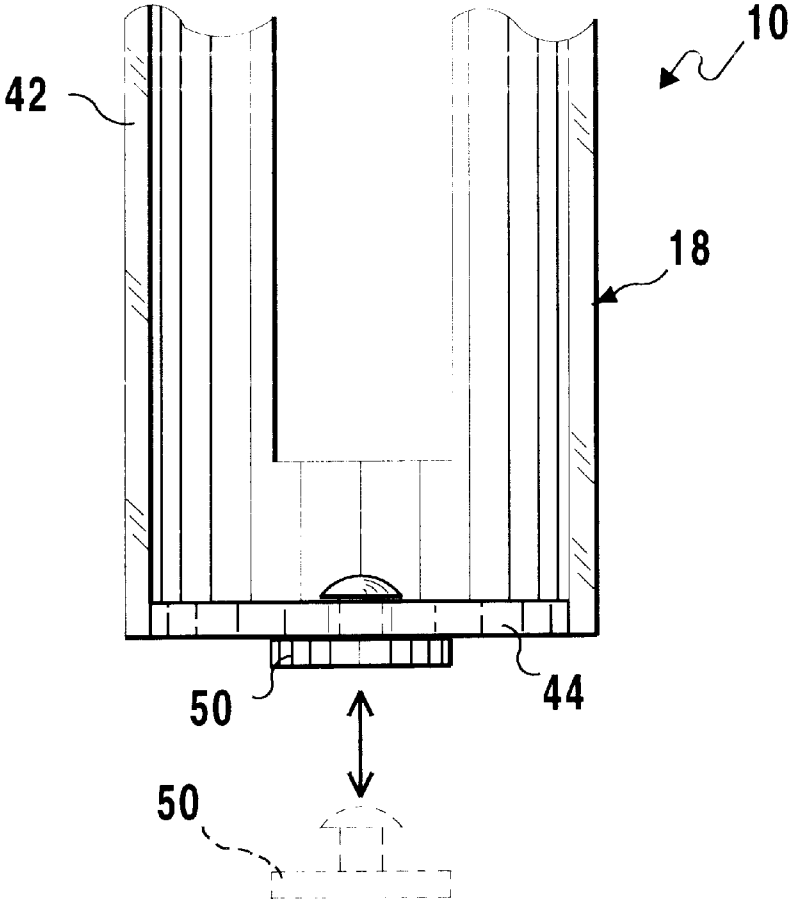

FIG. 6 is an enlarged front elevational view similar to FIG. 5, showing a small round rubber plug connected to the foot of the leg in place of the suction cup for use in a shower stall.

Similar reference characters denote corresponding features consistently throughout the attached drawings.

DESCRIPTION OF THE PREFERRED EMBODIMENTS

Turning now descriptively to the drawings, in which similar reference characters denote similar elements throughout several views, FIGS. 1 through 6 illustrate an easy shave foot support 10 of the present invention. With regard to the reference numerals used, the following numbering used throughout the various drawing figures.

10 easy shave foot support
12 foot supporting component of 10
14 foot of 16
16 person
18 elevating structure of 10
20 bathtub/shower stall
22 leg of 16
24 razor
26 platform of 12
28 footrest of 12
30 generally flat rectangular shaped horizontal plate for 26
32 web grid on 30
34 angled sole for 28
36 raised toe portion of 34
38 recessed heel portion of 34
40 raised rib on 34
42 leg of 18
44 non-slip foot on 42
46 suction cup on 44
48 floor of 20
50 small round rubber plug on 44
52 holder of 10 on 42
54 cylindrical shaped cup of 52
56 flat perforated bottom wall of 54
58 hard, durable plastic material for 10

The easy shave foot support 12 comprises a component 12 for supporting a foot 14 of a person 16. A structure 18 is for elevating the foot supporting component 12 within a bathtub or shower stall 20, at a height convenient for the person 16 to safely shave their legs 22 with a razor 24 while taking a shower.

The foot supporting component 12 consists of a platform 26 and a footrest 28 centrally located upon the platform 26. The platform 26 is a generally flat rectangular shaped horizontal plate 30. The plate 30 includes a web grid 32 integrally formed below, so as to reinforce the plate 30 to withstand pressure applied thereto by weight of the foot 14 of the person 16 placed upon the footrest 28.

The footrest 28 is an angled sole 34 integrally formed onto the platform 26. The angled sole 34 is shaped to have a raised toe portion 36 and a recessed heel portion 38, to comfortably receive either foot 14 of the person 16. The angled sole 34 includes a plurality of raised ribs 40 spaced apart in parallel relationships, to form a non-skid surface thereon to prevent slipping for the foot 14 of the person 16.

The elevating structure 18 consists of a plurality of legs 42, in which each leg 42 extends downwardly from one corner of the platform 26. Each leg 42 includes a non-slip foot 44 at its lower end.

As shown in FIGS. 3, 4 and 5, each non-slip foot 44 contains a suction cup 46 removably connected thereto for attachment to a floor 48 of the bathtub or the shower stall 20. As shown in FIG. 6, each non-slip foot 44 can contain a small round rubber plug 50 removably connected thereto to provide a firm support on a small tiled floor of the shower stall.

The easy shave foot support 10 further includes a pair of holders 52. Each holder 52 is integrally built into a top portion of one leg 42 at the corner of the platform 26, to retain a shaving cream container and the razor 24 used in shaving the legs 22 of the person 16. Each holder 52 is a cylindrical shaped cup 54, having a flat perforated bottom wall 56 to allow for drainage of water therefrom. The easy shave foot support 10 is formed as a one piece unit fabricated out of a hard, durable plastic material 58.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An easy shave foot support comprising:

a) means for supporting a foot of a person including:

i) a platform; and ii) a footrest centrally located upon said platform, wherein said platform is a generally flat rectangular shaped horizontal plate including a web grid integrally formed below, so as to reinforce said plate to withstand pressure applied thereto by weight of the foot of the person placed upon said footrest; and b) means for elevating said foot supporting means, within a bathtub and shower stall, at a height convenient for the person to safely shave their legs with a razor while taking a shower.

2. An easy shave foot support as recited in claim 1, wherein said footrest includes an angled sole integrally formed onto said platform, wherein said angled sole is shaped to have a raised toe portion and a recessed heel portion to comfortably receive either foot of the person.

3. An easy shave foot support as recited in claim 2, wherein said angled sole includes a plurality of raised ribs spaced apart in parallel relationships, to form a non-skid surface thereon to prevent slipping for the foot of the person.

4. An easy shave foot support as recited in claim 3, wherein said elevating means includes a plurality of legs, in which each said leg extends downwardly from one corner of said platform.

5. An easy shave foot support as recited in claim 4, wherein each said leg includes a non-slip foot at its lower end.

6. An easy shave foot support as recited in claim 5, wherein each said non-slip foot includes a suction cup removably connected thereto for attachment to a floor of the bathtub and the shower stall.

7. An easy shave foot support as recited in claim 6, wherein each said non-slip foot includes a small round rubber plug removably connected thereto to provide a firm support on a small tiled floor of the shower stall.

8. An easy shave foot support as recited in claim 7, further including a pair of holders, in which each said holder is integrally built into a top portion of one said leg at said corner of said platform, to retain a shaving cream container and the razor used in shaving the legs of the person.

9. An easy shave foot support as recited in claim 8, wherein each said holder is a cylindrical shaped cup having a flat perforated bottom wall to allow for drainage of water therefrom.

10. An easy shave foot support as recited in claim 9, wherein said easy shave foot support is formed as a one piece unit fabricated out of a hard, durable plastic material.

11. An easy shave foot support as recited in claim 1, wherein said elevating means includes a plurality of legs, in which each said leg extends downwardly from one corner of said platform.

12. An easy shave foot support as recited in claim 11, wherein each said leg includes a non-slip foot at its lower end.

13. An easy shave foot support as recited in claim 12, wherein each said non-slip foot includes a suction cup removably connected thereto for attachment to a floor of the bathtub and the shower stall.

14. An easy shave foot support as recited in claim 12, wherein each said non-slip foot includes a small round rubber plug removably connected thereto to provide a firm support on a small tiled floor of the shower stall.

15. An easy shave foot support as recited in claim 11, further including a pair of holders, in which each said holder is integrally built into a top portion of one said leg at said corner of said platform, to retain a shaving cream container and the razor used in shaving the legs of the person.

16. An easy shave foot support as recited in claim 15, wherein each said holder is a cylindrical shaped cup having a flat perforated bottom wall to allow for drainage of water therefrom.

17. An easy shave foot support as recited in claim 1, wherein said easy shave foot support is formed as a one piece unit fabricated out of a hard, durable plastic material.

* * * * *